US008040200B2

(12) United States Patent
Minegishi et al.

(10) Patent No.: US 8,040,200 B2
(45) Date of Patent: Oct. 18, 2011

(54) PARALLEL DIFFERENTIAL TRANSMISSION LINES HAVING AN OPPOSING GROUNDING CONDUCTOR SEPARATED INTO TWO PARTS BY A SLOT THEREIN

(75) Inventors: Akira Minegishi, Osaka (JP); Toru Yamada, Osaka (JP); Kazuhide Uriu, Osaka (JP); Susumu Sawada, Osaka (JP)

(73) Assignee: Panasonic Corporation, Osaka (JP)

( * ) Notice: Subject to any disclaimer, the term of this patent is extended or adjusted under 35 U.S.C. 154(b) by 131 days.

(21) Appl. No.: 12/486,912

(22) Filed: Jun. 18, 2009

(65) Prior Publication Data

US 2009/0315649 A1 Dec. 24, 2009

(30) Foreign Application Priority Data

Jun. 19, 2008 (JP) ..... 2008-160446

(51) Int. Cl.
*H01P 3/08* (2006.01)

(52) U.S. Cl. ..... 333/4; 333/33; 333/238

(58) Field of Classification Search ..... 333/1, 4, 333/33, 238, 246
See application file for complete search history.

(56) References Cited

U.S. PATENT DOCUMENTS

| | | | | |
|---|---|---|---|---|
| 5,539,360 | A * | 7/1996 | Vannatta et al. | 333/4 |
| 6,219,255 | B1 * | 4/2001 | Teshome | 361/794 |
| 7,397,320 | B1 * | 7/2008 | Bokhari | 333/1 |
| 2005/0140458 | A1 * | 6/2005 | Clark | 333/1 |
| 2009/0079523 | A1 * | 3/2009 | Hsu | 333/246 |

FOREIGN PATENT DOCUMENTS

| | | |
|---|---|---|
| EP | 1 376 747 | 1/2004 |
| JP | 2004-48750 | 2/2004 |

OTHER PUBLICATIONS

F. Gisin et al., "Routing differential I/O signals across split ground planes at the connector for EMI control", 2000 IEEE International Symposium on Electromagnetic Compatibility, vol. 1, pp. 325-327, Aug. 2000.

M. Kirschning et al., "Measurement and computer-aided modeling of microstrip discontinuities by an improved resonator method", 1983 IEEE MTT-S International Micro wave Symposium Digest, vol. 83, pp. 495-497, May 1983.

A. Weisshaar et al., "Modeling of radial microstrip bends", 1990 IEEE MTT-S International Microwave Symposium Digest, vol. 3, pp. 1051-1054, May 1990.

* cited by examiner

*Primary Examiner* — Benny Lee
(74) *Attorney, Agent, or Firm* — Wenderoth, Lind & Ponack, L.L.P.

(57) ABSTRACT

In a differential transmission line, a substrate has first and second surfaces parallel to each other, and a first grounding conductor is formed on the second surface of the substrate. A dielectric layer is formed on the first grounding conductor, and a second grounding conductor is formed on the dielectric layer. First and the second signal conductors are formed to be parallel to each other on the first surface of the substrate. The first signal conductor and the first and second grounding conductors constitute a first transmission line, and the second signal conductor and the first and second grounding conductors constitute a second transmission line. A slot is formed in the first grounding conductor to three-dimensionally intersect with the first and second signal conductors and to be orthogonal to a longitudinal direction thereof, and a connecting conductor is formed for connecting the first grounding conductor with the second grounding conductor.

8 Claims, 11 Drawing Sheets

PARALLEL DIFFERENTIAL TRANSMISSION LINES HAVING AN OPPOSING GROUNDING CONDUCTOR SEPARATED INTO TWO PARTS BY A SLOT THEREIN

BACKGROUND OF THE INVENTION

1. Field of the Invention

The present invention relates to a differential transmission lines and, in particular, to a differential transmission line that transmits an analog high-frequency signal or a digital signal in a microwave band, a sub-millimeter wave band or a millimeter wave band.

2. Description of the Related Art

A differential signal transmission system, which has less radiation and is also robust to noises as compared with the single-ended signal transmission system that has been conventionally used, has been increasingly used for high-speed signal transmissions.

FIG. 12 is a top view of a prior art differential transmission line. FIG. 13 is a longitudinal sectional view along the line C-C' of the differential transmission line of FIG. 12 showing an electric field vector Ee in an odd mode. FIG. 14 is a longitudinal sectional view along the line C-C' of the differential transmission line of FIG. 12 showing an electric field vector Eo in an even mode.

Referring to FIGS. 12 to 14, a grounding conductor 11 (FIGS. 13 and 14) is formed on the back surface of a dielectric substrate 10, and strip-shaped signal conductors 2*a* and 2*b* in parallel to each other are formed on the front surface of the dielectric substrate 10. Differential high-frequency signals of signs opposite to each other are applied to the two signal conductors 2*a* and 2*b*, and the line functions as a differential transmission line. That is, a first microstrip line 20*a* (FIG. 12) is constituted by including the signal conductor 2*a* and the grounding conductor 11 sandwiching the dielectric substrate 10, and a microstrip line 20*b* (FIG. 12) is constituted by including the signal conductor 2*b* and the grounding conductor 11 sandwiching the dielectric substrate 10. In this case, the differential transmission line is constituted by including a pair of the microstrip lines 20*a* and 20*b*.

If the two microstrip lines 20*a* and 20*b* are adjacently placed to be parallel to each other so as to be electromagnetically coupled with each other as shown in FIGS. 12 to 14, two modes of the even mode in which signals in an identical direction are transmitted through the two microstrip lines 20*a* and 20*b* and the odd mode in which signals in opposite directions are transmitted are generated. In the differential transmission line, a differential signal is transmitted by utilizing the odd mode.

The electric field vector Ee in the odd mode is schematically indicated by the arrow of FIG. 13, and the direction of the electric field vector Eo in the even mode is schematically indicated by the arrow of FIG. 14. In the odd mode, as shown in FIG. 13, the electric field vector Ee is directed from one signal conductor 2*a* toward the other signal conductor 2*b*, and the magnitude of the electric field vector directed from the signal conductor 2*a* to the grounding conductor 11 is small. That is, a virtual ground plane is formed on the symmetry plane of the two signal conductors 2*a* and 2*b* according to the differential transmission in the odd mode.

In designing a differential transmission line, a circuit design such that the inputted differential signal is not converted into a common-mode signal is indispensable. For example, in order for two signals inputted with opposite phases and an equal amplitude to keep the opposite-phase equal-amplitude relation, it is necessary to keep a circuit symmetry of the two microstrip lines 20*a* and 20*b*, through which the respective signals are transmitted. That is, the two microstrip lines 20*a* and 20*b* that constitute the differential transmission line need to be a pair of transmission lines that have identical amplitude characteristics and phase characteristics. However, at the bends of the differential transmission line (i.e., bend regions of the two microstrip lines 20*a* and 20*b*), unnecessary mode conversion from the differential signal to the common-mode signal easily occurs.

The Patent Document 1 of the first prior art discloses a measure for removing the unnecessary common-mode signal that has been disadvantageously superimposed on the differential transmission line. FIG. 15 is a top view showing differential transmission lines 20A and 20B of the first prior art. The construction of the differential transmission lines 20A and 20B disclosed in the Patent Document 1 is described below with reference to FIG. 15.

Referring to FIG. 15, a plurality of slots 21 are formed at a grounding conductor (not shown, but referring to a ground conductor formed on the back surface of the dielectric substrate 10) just under the differential transmission lines 20A and 20B. The slots 21 extend in a direction orthogonal to the transmission direction 25 of a differential signal. By adopting the construction as described above, impedance to the common-mode signal is selectively increased, and the common-mode signal is reflected. According to the differential-mode transmission, a virtual high-frequency ground plane is formed between a pair of signal conductors 2*a* and 2*b* that constitute the differential transmission line 20A, and therefore, an influence on the transmission characteristic is small even if the plurality of slots 21 are formed on the grounding conductor. Therefore, at the differential transmission lines 20A and 20B of the first prior art described in the Patent Document 1, the transmission characteristic in the differential mode is not negatively influenced, and it is possible to reduce a common-mode signal transmission intensity.

The Patent Document 1 further discloses a method for removing the common-mode signal at the bends of the differential transmission line 20B. That is, the Patent Document 1 describes that it is effective for the removal of the common-mode signal to form a slot 23 in a direction orthogonal to the local signal transmission direction 27 also in the case where the differential transmission line 20B has a bend shape as in the case of the linear shape. Moreover, the Non-Patent Document 1 discloses a principle that the common mode can be removed by forming the slots 21 and 23 at the grounding conductor.

The related documents to the present invention are as follows:

Patent Document 1: JP 2004-048750 A;

Non-Patent Document 1: F. Gisin et al., "Routing differential I/O signals across split ground planes at the connector for EMI control", 2000 IEEE International Symposium on Electromagnetic Compatibility, Vol. 1, pp. 325-327, August 2000;

Non-Patent Document 2: M. Kirschning et al., "Measurement and computer-aided modeling of microstrip discontinuities by an improved resonator method", 1983 IEEE MTT-S International Micro wave Symposium Digest, Vol. 83, pp. 495-497, May 1983; and Non-Patent Document 3: A. Weisshaar et al., "Modeling of radial microstrip bends", 1990 IEEE MTT-S International Microwave Symposium Digest, Vol. 3, pp. 1051-1054, May 1990;

However, according to the prior art described above, the intensity of the common-mode signal transmitted through the differential transmission line can be reduced when the common-mode signal is inputted, whereas there is neither disclosure nor suggestion regarding a reduction in the unnecessary mode conversion intensity with which the common-mode signal is outputted when the differential signal is inputted.

FIG. 16 is a top view showing a differential transmission line 20C according to the Non-Patent Document 2 of a second prior art. The Non-Patent Document 2 discloses that the transmission characteristic is improved by removing the corner 29 of a signal conductor 2 at the bend of the single-ended microstrip line 20C as shown in FIG. 16. In general, a grounding capacitance generated between the signal conductor 2 and the grounding conductor tends to increase at the bend of the microstrip line 20C in comparison with the linear regions. Therefore, when the area of the signal conductor 2 is reduced at the bend, the transmission characteristic is improved. This technique is widely used for the contemporary high-frequency circuit design. As for software or the like to make a layout chart from a circuit diagram, it is often the case where the removal of the corner portion at the bend of the signal conductor is automatically set.

The Non-Patent Document 3 of a third prior art reports the high-frequency characteristic of a line structure exhibiting a satisfactory value as a transmission characteristic in the high-frequency band at the bend of the single-ended microstrip line. Although it is contemplated that the reflection of the transmission signal might occur in the construction of the second prior art, the high-frequency characteristic is improved by assuming the center of curvature at the curve of the transmission line and laying the signal conductor gently curved in the construction of the third prior art. Such a construction is also generally used in the high-frequency circuit to transmit particularly a high-frequency signal.

FIG. 17 is a top view showing a differential transmission line 20D according to a modified example of the first prior art. The bends of the differential transmission line shown in FIG. 17 can be achieved on the basis of the disclosed contents of the first prior art. The line structure of the bends shown in FIG. 17 corresponds to one such that the slot 23 is removed from the line structure of the bend shown in FIG. 15.

FIG. 18 is a top view showing a differential transmission line 20E according to a modified example of the third prior art. It is also possible to achieve the curve of the differential transmission line shown in FIG. 18 on the basis of the disclosed contents of the third prior art. In this case, the center of curvature is assumed at the curve, and two signal conductors 2*a* and 2*b* that are arranged gently curved are arranged so as to be parallel to each other.

According to the constructions of the Patent Document 1 and the Non-Patent Document 1, the effect of suppressing the unnecessary mode conversion from the differential signal (i.e., transmission signal in the odd mode) to the common-mode signal (i.e., transmission signal in the even mode) at the bends and asymmetric lines cannot be obtained. Since the unnecessary mode conversion significantly occurs as the transmission frequency increases at the bends of the differential transmission line, satisfactory differential-mode transmission cannot be achieved. Moreover, even if the structures proposed to improve the high-frequency characteristic of single-ended signal transmission by the Non-Patent Documents 2 and 3 are applied to the bends of the differential transmission line, the unnecessary mode conversion cannot be sufficiently suppressed.

SUMMARY OF THE INVENTION

An object of the present invention is to solve the above problems and provide a differential transmission line such that the unnecessary mode conversion due to a difference in the length between bends or between differential wiring lines can be suppressed.

According to one aspect of the present invention, there is provided a differential transmission line including a substrate, first and second grounding conductors, a dielectric layer, and first and second signal conductors. The substrate has a first surface and a second surface that are substantially parallel to each other, the first grounding conductor is formed on the second surface of the substrate, and the dielectric layer is formed on the first grounding conductor. The second grounding conductor formed on the dielectric layer, and the first and the second signal conductors formed so as to be parallel to each other on the first surface of the substrate. The first signal conductor and the first and second grounding conductors constitutes a first transmission line, and the second signal conductor and the first and second grounding conductors constitutes a second transmission line. The differential transmission line further includes a slot, and a connecting conductor. The slot is formed in the first grounding conductor so as to three-dimensionally intersect with the first and second signal conductors and to be substantially orthogonal to a longitudinal direction of the first and second signal conductors, and the connecting conductor is formed for connecting the first grounding conductor with the second grounding conductor.

In the above-mentioned differential transmission line, the slot is formed so as to penetrate the first grounding conductor in a thickness direction of the first grounding conductor, and the first grounding conductor is divided into two parts so as to be completely separated apart by the slot.

In addition, in the above-mentioned differential transmission line, the slot includes a bend formed between the first signal conductor and the second signal conductor.

Further, in the above-mentioned differential transmission line, the slot includes first and second slots. The first slot having a first width is formed so as to intersect with the first signal conductor, and the second slot, having a second width different from the first width, is formed so as to intersect with the second signal conductor.

Still further, in the above-mentioned differential transmission line, a difference between the first width and the second width is set to be larger than a difference between a length of the first signal conductor and a length of the second signal conductor.

Still further, in the above-mentioned differential transmission line, a plurality of the slots are formed in the first grounding conductor.

According to the differential transmission line of the present invention, the slots are formed in the first grounding conductor so as to three-dimensionally intersect with the first and second signal conductors and to be substantially orthogonal to the longitudinal direction of the first and second signal conductors. Therefore, the unnecessary mode conversion that occurs due to a difference in the wiring length between the differential wiring lines generated at the bends and the like of the conventional differential transmission line can be suppressed, and this leads to a reduction in the amount of unnecessary emission. Moreover, a common-mode suppression filter, which has been inserted for the purpose of unnecessary common-mode removal in the conventional differential transmission line, becomes unnecessary, and this therefore makes it possible to achieve a cost reduction, a reduction in the circuit occupation area and an improvement in the differential-mode transmission signal intensity that have been deteriorated due to insertion of the common-mode filter.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
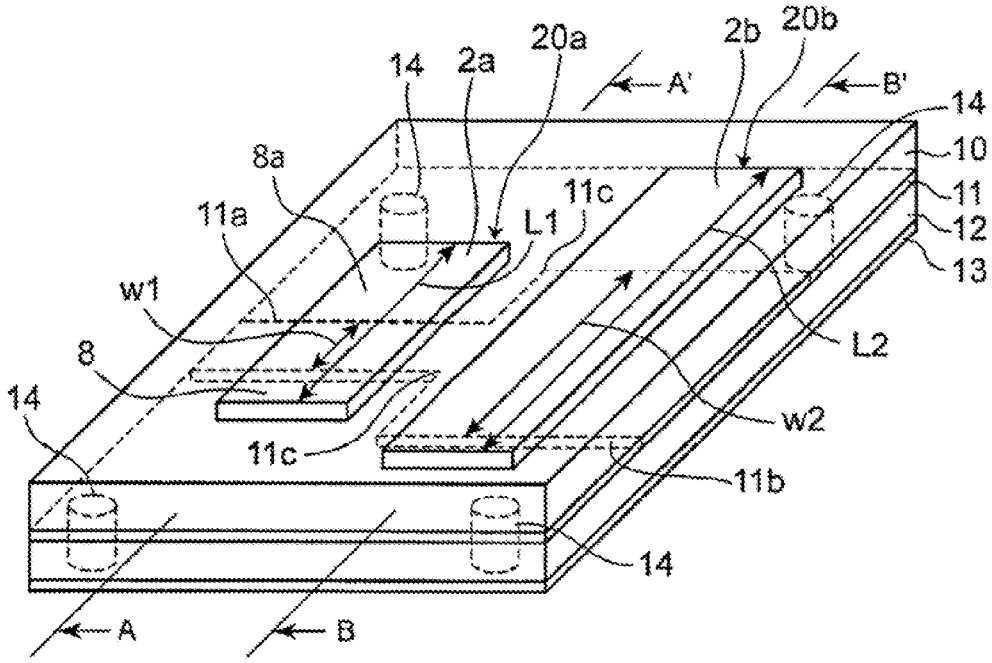
FIG. 1 is a perspective view of a differential transmission line according to one preferred embodiment of the present invention.

Preferred embodiments of the present invention will be described below with reference to the drawings. It is noted that like components are denoted by like reference numerals in the following preferred embodiments and may not be described in detail in connection with every drawing figure in which they appear. Moreover, dashed lines show components in the hidden positions in the drawings.

Preferred Embodiments

First of all, a differential transmission line according to one preferred embodiment of the present invention is described below with reference to FIGS. 1 to 4. FIG. 1 is a perspective view of a differential transmission line according to one preferred embodiment of the present invention, and FIG. 2 is a top view of the differential transmission line of FIG. 1.

Figure 2:
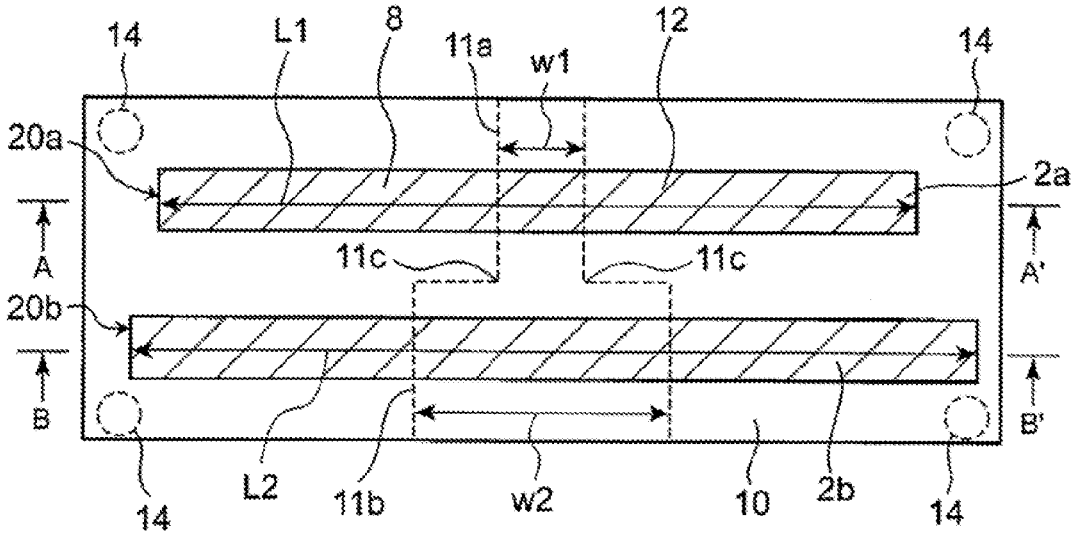
FIG. 2 is a top view of the differential transmission line of FIG. 1.

Referring to FIGS. 1 and 2, the differential transmission line of the present preferred embodiment is constituted by including a dielectric substrate 10 of a parallel flat plate that has front surface and back surface which are formed substantially parallel to each other, a grounding conductor 11 (FIG. 1) formed on the back surface of the dielectric substrate 10, a dielectric layer 12 formed on the grounding conductor 11, a grounding conductor 13 (FIG. 1) formed on the dielectric layer 12, and a pair of strip-shaped signal conductors 2*a* and 2*b* formed in parallel to each other on the front surface of the dielectric substrate 10. In this case, a microstrip line 20*a* that is the first transmission line is constructed by including the signal conductor 2*a* and the grounding conductors 11 and 13 sandwiching the dielectric substrate 10, and a microstrip line 20*b* that is the second transmission line is constructed by including the signal conductor 2*b* and the grounding conductors 11 and 13 sandwiching the dielectric substrate 10. A differential transmission line is constructed by including a pair of microstrip lines 20*a* and 20*b*.

Moreover, at the grounding conductor 11, slots 11*a* and 11*b* are formed so as to three-dimensionally intersect with the signal conductors 2*a* and 2*b* and to be substantially orthogonal to the longitudinal direction of the signal conductors 2*a* and 2*b*. The slots 11*a* and 11*b* are formed preferably penetrating the thickness direction of the grounding conductor 11 and formed divided in two parts so as to be completely cut by the slots 11*a* and 11*b*. The slots 11*a* and 11*b* have bent portions 11*c* in positions located between the signal conductor 2*a* and the signal conductor 2*b*. In this case, the slot 11*a* having a width w1 is formed so as to intersect with the signal conductor 2*a* having length L1, and the slot 11*b* having a width w2 different from the width w1 is formed so as to intersect with the signal conductor 2*b* having length L2, where the widths w1 and w2 are preferably set according to the following Equation as described in detail later:

$$|w1-w2| \geqq |L1-L2| \quad (1).$$

Further, at the four corners of the dielectric substrate 10 are formed via conductors 14 that are made of a conductor filled in a via-hole penetrating the dielectric layer 12 in the thickness direction and elastically connect the grounding conductor 11 with the grounding conductor 13.

Figure 19:
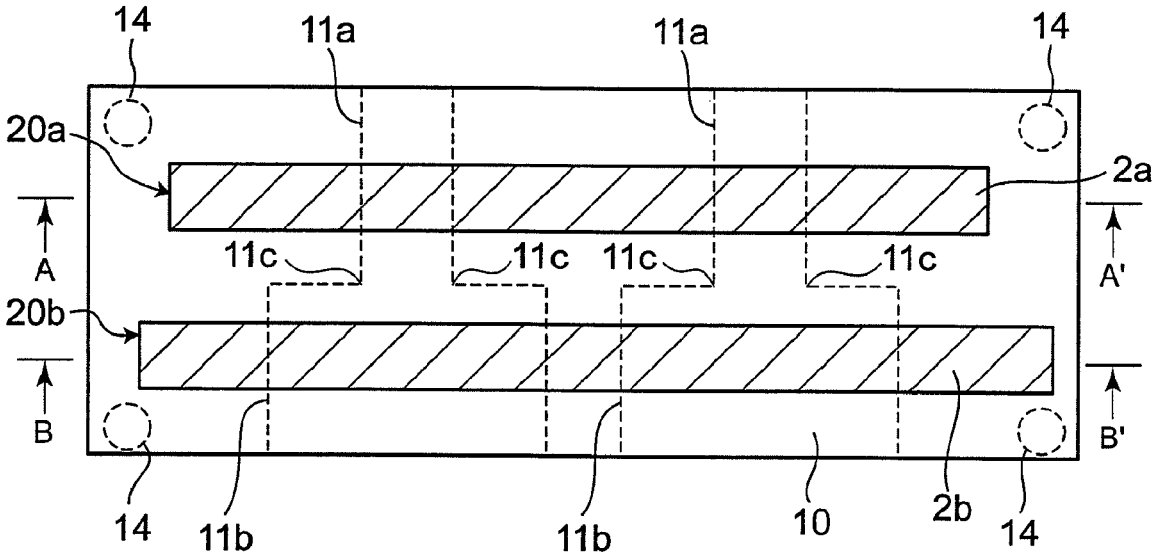
FIG. 19 is a top view showing a differential transmission line according to a modified preferred embodiment of the present invention.

Although one slot is formed by connecting the two slots 11*a* and 11*b* in the preferred embodiment of FIGS. 1 and 2, two or a plurality of slots 11*a* and 11*b* may be formed as shown in the modified preferred embodiment of FIG. 19. Moreover, the dielectric substrate 10 may be a semiconductor substrate. Further, the grounding conductors 11 and 13 and the dielectric layers 12 may be formed in an internal layer of the dielectric substrate 10. In this case, the internal layer of the dielectric substrate 10 includes not only the internal layer of the dielectric substrate 10 itself but also, when another layer is formed on the back surface of the dielectric substrate 10, the surface of the layer. Moreover, the grounding conductors 11 and 13 may be covered with other layers. In a manner similar to that of above, the front surface of the dielectric substrate 10 includes not only the front surface of the dielectric substrate 10 but also, when another layer is formed on the front surface of the dielectric substrate 10, the surface of the layer. Moreover, the signal conductors 2*a* and 2*b* and the grounding conductors 11 and 13 may be covered with other layers.

Although a pair of signal conductors 2*a* and 2*b* are formed in parallel to each other for the sake of the structure of the dielectric substrate 10 in the differential transmission line of FIGS. 1 and 2, the length L1 of the signal conductor 2*a* and the length L2 of the signal conductor 2*b* are different from each other (L1≠L2) since a distance between the terminals is varied.

In the present preferred embodiment, the slots 11*a* and 11*b* are formed at the grounding conductor 11. The slots 11*a* and 11*b* are elongated in a direction orthogonal to the local transmission direction of a high-frequency transmission signal propagating in the longitudinal direction of the signal conductors 2*a* and 2*b*. In the preferred embodiment of FIGS. 1 and 2, the grounding conductor 11 and the grounding conductor 13 are elastically connected together by the via-holes 14 at one end of the slots 11*a* and 11*b*. However, in order to obtain the effect of the present invention, it is only required that the separated parts of the grounding conductor 11 separated by the slots 11*a* and 11*b* are connected to the grounding conductor 13 by at least one via conductor 14.

In the present preferred embodiment, the slots 11*a* and 11*b* are high-frequency circuit elements obtained by removing part of the grounding conductor 11. The slots 11*a* and 11*b* as described above can easily be formed, for example, as follows. That is, after the grounding conductor 11 is deposited on the entire back surface of the dielectric substrate 10, the surface of the grounding conductor 11 is covered with a mask (e.g., a resist mask) that has an opening to define the formation patterns of the slots 11*a* and 11*b*. Next, by removing a portion, which is exposed via the opening of the mask, of the grounding conductor 11 by the wet etching method, the slots 11*a* and 11*b* that have desired shapes in the arbitrary positions of the grounding conductor 11 can be formed. A grounding conductor 11 having an opening pattern corresponding to the slots 11*a* and 11*b* may be formed by the lift-off method in forming the grounding conductor 11. In this case, the slots 11*a* and 11*b* are the portions obtained by removing part of the grounding conductor 11 completely in the thickness direction. Further, the signal conductors 2*a* and 2*b* formed on the front surface of the dielectric substrate 10 can be formed by, for example, depositing a conductor layer on the entire front surface of the dielectric substrate 10 and thereafter selectively partially removing the conductor layer.

Figure 7:
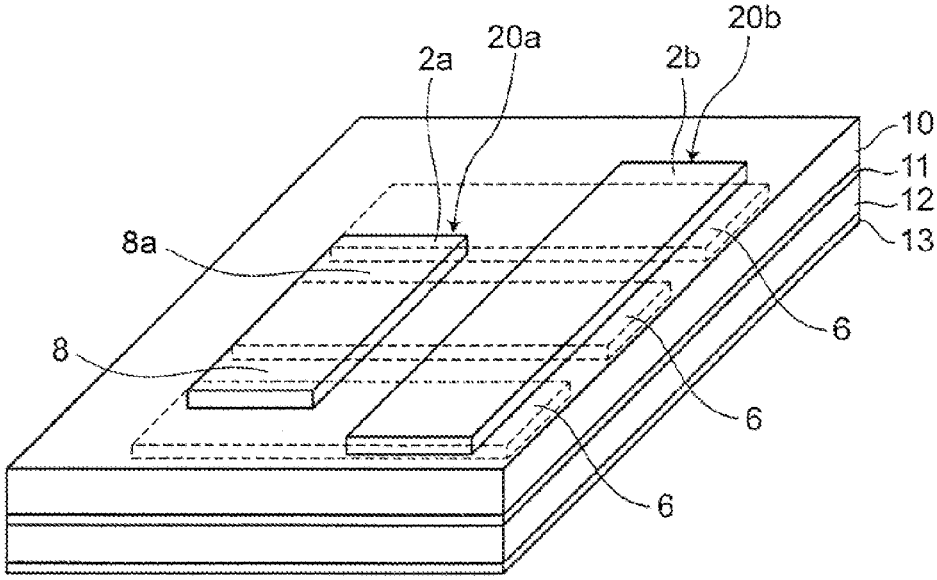
Fig.7 PRIOR ART
FIG. 7 is a perspective view of a differential transmission line according to the first prior art.
Figure 8:
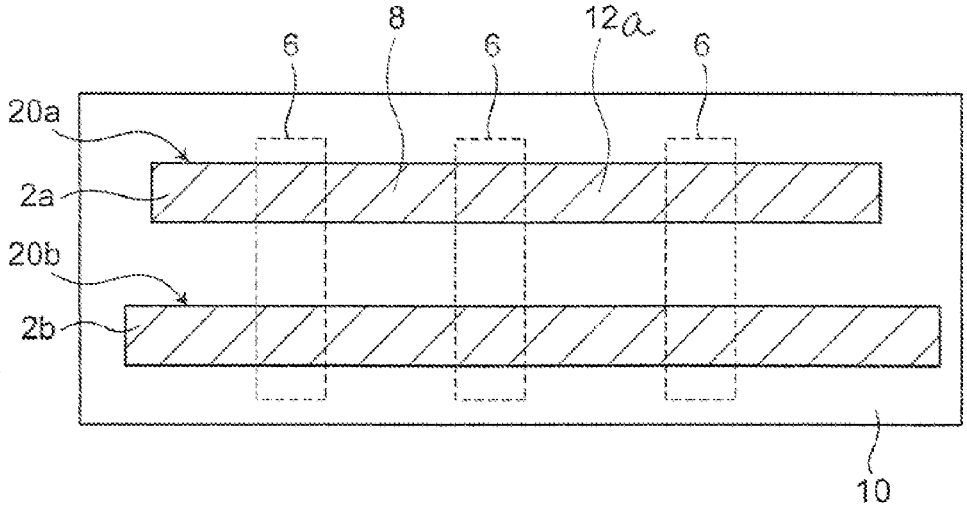
Fig.8 PRIOR ART
FIG. 8 is a top view of the differential transmission line of FIG. 7.

FIG. 7 is a perspective view of the differential transmission line of the first prior art, and FIG. 8 is a top view of the differential transmission line of FIG. 7. That is, FIGS. 7 and 8 show a structure in which the slot 6 disclosed in the Patent Document 1 is formed at the differential transmission line for the sake of comparison with the preferred embodiment. Referring to FIGS. 7 and 8, a plurality of slots 6 are provided orthogonally to the local signal transmission direction of the differential transmission line constructed by including a pair of the microstrip lines 20*a* and 20*b* that have the signal conductor 2*a* and 2*b*, respectively, and the slots 6 are connected to each other by the conductor portion of the grounding conductor 11.

As apparent from a comparison between the first prior art of FIGS. 7 and 8 and the preferred embodiment of FIGS. 1 and 2, the slots 11*a* and 11*b* of the present preferred embodiment largely differ from the slots 6 of the first prior art of FIGS. 7 and 8 in that the grounding conductor 11 having the slots 11*a* and 11*b* is completely cut and connected by the grounding conductor 13 of another layer.

In the present preferred embodiment, the length L1 of the microstrip line 20*a* that is the first transmission line is shorter than the length L2 of the microstrip line 20*b* that is the second transmission line, and therefore, an electrical length difference attributed to the path length difference of a high-frequency current is generated. In order to suppress the unnecessary mode conversion from the differential mode to the common mode, it is preferable to symmetrize the two transmission lines that form the differential transmission line in terms of circuit, and the electrical length difference needs to be compensated for.

The plurality of slots 6 of the first prior art of FIGS. 7 and 8 do not function to compensate for the electrical length difference between the transmission lines. In contrast to this, the slots 11*a* and 11*b* of the present preferred embodiment can contribute to the compensation for the electrical length difference. How the electrical length difference is compensated for in the present preferred embodiment is described below.

In each of the construction of the preferred embodiment shown in FIGS. 1 and 2 and the construction of the first prior art shown in FIGS. 7 and 8, the grounding conductor 11 (FIGS. 1 and 7) located just under one point 8 on the signal conductor 2*a* functions as a grounding conductor of high-frequency transmission. In a manner similar to that of above, the grounding conductor 11 located just under the other one point 8*a* on the signal conductor 2*a* functions as a grounding conductor of high-frequency transmission.

Figure 3:
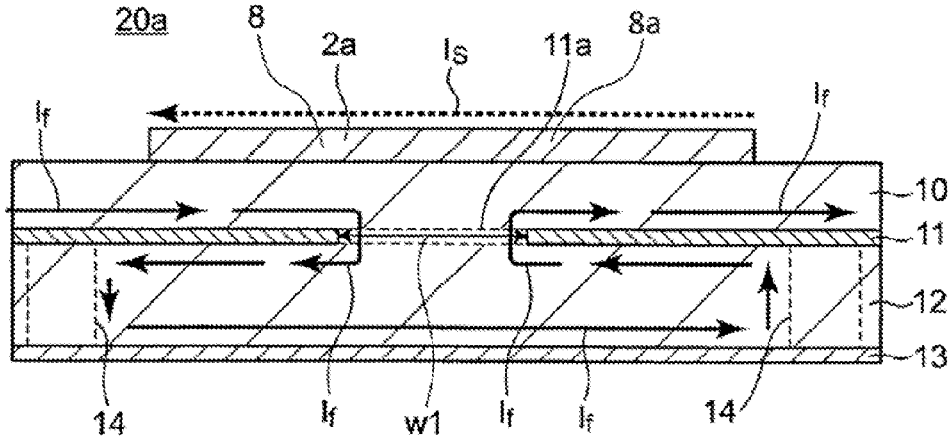
FIG. 3 is a longitudinal sectional view taken along the line A-A' of FIGS. 1 and 2.
Figure 4:
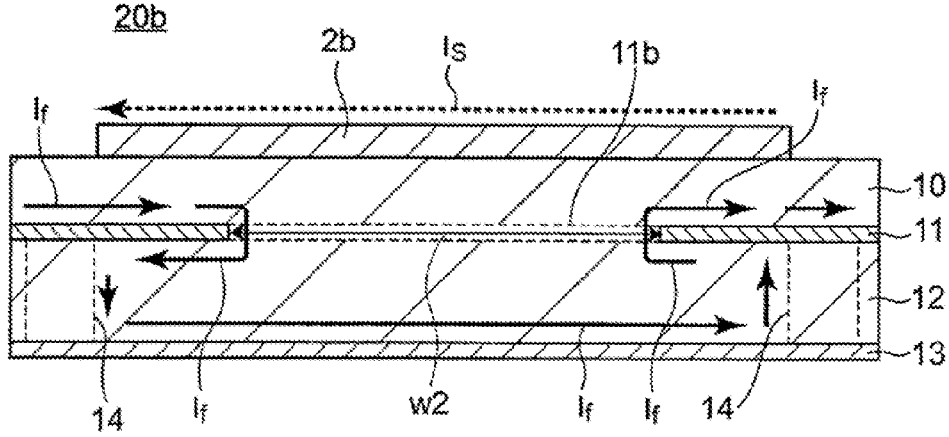
FIG. 4 is a longitudinal sectional view taken along the line B-B' of FIGS. 1 and 2.

FIG. 3 is a longitudinal sectional view taken along the line A-A' of FIGS. 1 and 2, and FIG. 4 is a longitudinal sectional view taken along the line B-B' of FIGS. 1 and 2. That is, FIG. 3 is a longitudinal sectional view of the microstrip line 20*a*, and FIG. 4 is a longitudinal sectional view of the microstrip line 20*b*. In FIGS. 3 and 4, Is denotes a direction of a signal current, and If denotes a direction of a return circuit current.

When the high-frequency signal moves on the signal conductor 2*a* from the point 8 to the point 8*a* in the longitudinal sectional view of the microstrip line 20*a* of FIG. 3, the path of the high-frequency current in the grounding conductor 11 corresponding to the high-frequency signal transmission is interrupted by the slot 11*a* between the point 8 and the point 8*a*. Therefore, as indicated by the arrow of the return circuit current If of FIG. 3, the high-frequency current in the grounding conductor 11 corresponding to the signal transmission traces an edge portion of the slot 11*a*, thereafter makes a detour while being transmitted through the back surface of the grounding conductor 11, and eventually flows to the grounding conductor 13 of the third layer of a lower impedance via the via conductors 14. Moreover, in a manner similar to that in the longitudinal sectional view of the microstrip line 20*b* of FIG. 4, the current is transmitted from a peripheral portion of the grounding conductor 11 corresponding to the high-frequency signal transmission by the slot 11*b*, and then, is transmitted to the grounding conductor 13 via the via conductors 14.

In this case, since the slots 11*a* and 11*b* interrupt the current path on the grounding conductor 11, the effect of making the detour of the high-frequency current path in the grounding conductor layer 11 is more intensified in the microstrip line 20*a* than in the microstrip line 20*b*. As a result, the electrical length is relatively extended in the microstrip line 1*a* of which the electrical length is relatively short, and the electrical length difference generated between the signal conductors 2*a* and 2*b* are compensated for by that much.

In contrast to this, when the high-frequency signal moves on the signal conductor 2*a* from the point 8 to the point 8*a* in the first prior art of FIGS. 7 and 8, a current path of the same distance is traced although the high-frequency current in the grounding conductor 11 (FIG. 7) is inhibited from traveling linearly from the point 8 to the point 8*a*. Therefore, as indicated by the arrow If in FIGS. 3 and 4, it is possible that a path of a short electrical length is traced. Unless the path is inhibited, the detour structure is not achieved in the movement path of the high-frequency current at the grounding conductor layer 11 in the microstrip line 20*a*, and the electrical length difference generated between the signal conductors 2*a* and 2*b* cannot be compensated for.

In order to achieve the purpose of the present invention, it is required not only to form the slots 11*a* and 11*b* but also to preferably make the slots 11*a* and 11*b* located just under the microstrip line 20*a* and the microstrip line 20*b* have widths to compensate for the difference in the wiring lengths L1 and L2 between a pair of the lines 20*a* and 20*b*. Therefore, the widths w1 (FIG. 3) and w2 (FIG. 4) are set according to the following Equation:

$$|w1-w2| \geqq |L1-L2| \quad (2).$$

The resonance frequency of the slots 11*a* and 11*b* needs to be set to a value higher than the transmission frequency.

As described above, according to the present preferred embodiment, the electrical length difference at any bends of a pair of lines 20*a* and 20*b* that constitute the differential transmission line is reduced, and therefore, the unnecessary mode conversion is suppressed.

Implemental Examples

The operation and advantageous effects of the preferred embodiment of the present invention are described below by using examples of comparative experiments with an electromagnetic simulator capable of taking a difference in the wiring structure directly into consideration.

By using a dielectric substrate of a three-layer structure in which the dielectric constant of the dielectric substrate 10 and the dielectric layer 12 was 4.2, the thickness of the dielectric substrate 10 and the dielectric layer 12 was 100 μm, and the thickness of the signal conductors 2*a* and 2*b* and the grounding conductors 11 and 13 was 30 μm as a circuit board, the first implemental example of the differential transmission line of the present preferred embodiment of the present invention and the third prior art were analyzed. In this case, the wiring lines were provided by the microstrip lines 20*a* and 20*b* of a line width of 65 μm as a condition corresponding to a characteristic impedance of 50Ω in the odd mode, and the two wiring lines were arranged parallel by a setting of a line gap width of 70 μm as the signal conductors 2*a* and 2*b* of the differential transmission line. The analyzed line structure was such that the length L1 of the signal conductor 2*a* was 5 mm, and the length L2 of the signal conductor 2*b* was 7 mm.

The inventors conducted an estimation of the transmission characteristics by analysis with an electromagnetic simulator. Analytical results of a four-terminal scattering matrix were obtained in the frequency band of frequencies up to 10 GHz. The obtained four-terminal scattering matrix was converted to obtain a two-terminal scattering matrix in each mode of differential transmission, and the transmission coefficient $S_{21}$ of the converted signal to the unnecessary mode (common-mode power) was calculated. It is noted that the "common-mode power" indicates how intense a common-mode signal is outputted from the other differential port when a differential signal is inputted to a differential port. These measurements and data processing are general techniques used upon estimating the differential transmission characteristic. Moreover, a transmission waveform characteristic at a frequency of 1 GHz by a circuit analysis using the analytical results was obtained.

Figure 5:
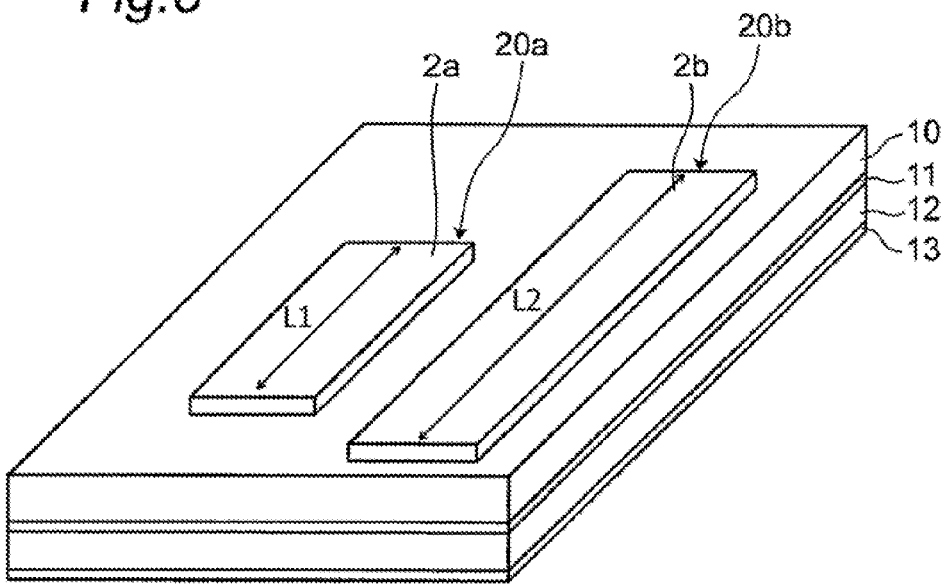
FIG. 5 is a perspective view of a differential transmission line according to a comparative example.
Figure 6:
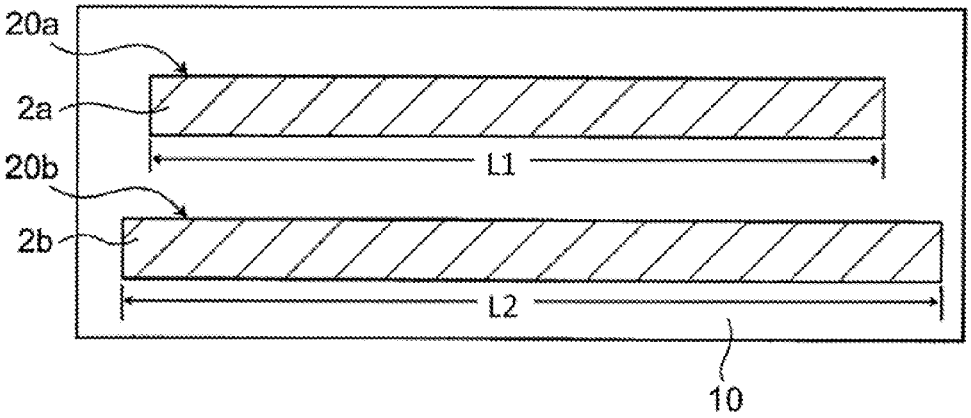
FIG. 6 is a top view of the differential transmission line of FIG. 5.

FIG. 5 is a perspective view of a differential transmission line according to a comparative example, and FIG. 6 is a top view of the differential transmission line of FIG. 5. Referring to FIGS. 5 and 6, according to the differential transmission line of the comparative example, the microstrip lines 20*a* and 20*b* of a line width of 65 μm were arranged parallel by a setting of a line gap width of 70 μm, and there were used as the signal conductors 2*a* and 2*b* of the differential transmission line. The analyzed line structure was such that the length L1 of the signal conductor 2*a* was set to 5 mm, and the length L2 of the signal conductor 2*b* was set to 7 mm.

FIG. 7 is a perspective view of the differential transmission line of the first prior art, and FIG. 8 is a top view of the differential transmission line of FIG. 7. Referring to FIGS. 7 and 8, according to the differential transmission line of the first prior art, three slots 6 were formed at the grounding conductor 11 in addition to the differential transmission line of the comparative example. The slots 6 were arranged at regular intervals at the bends and orthogonal to one another in the signal transmission direction. The slot width was set to 80 μm, and the slot length was set to 600 μm.

Comparing the characteristics of the examples at a frequency of 10 GHz, the converted signals to the unnecessary mode were generated by −31.2 dB in the comparative example and by −32.4 dB in the first prior art. Therefore, the converted signal to the unnecessary mode was generated more intensely in the comparative example than in the first prior art.

Next, a description is made by comparing the first implemental example of the present the invention with the first prior art. The differential transmission line of the preferred embodiment shown in FIGS. 1 and 2 was made for a trial purpose as a first implemental example. In the first implemental example, the slot width w1 was set to 80 μm equal to that of the first prior art, and the slot width w2 was set to 150 μm. The other setting parameters were on the same conditions as those of the first prior art.

Figure 9:
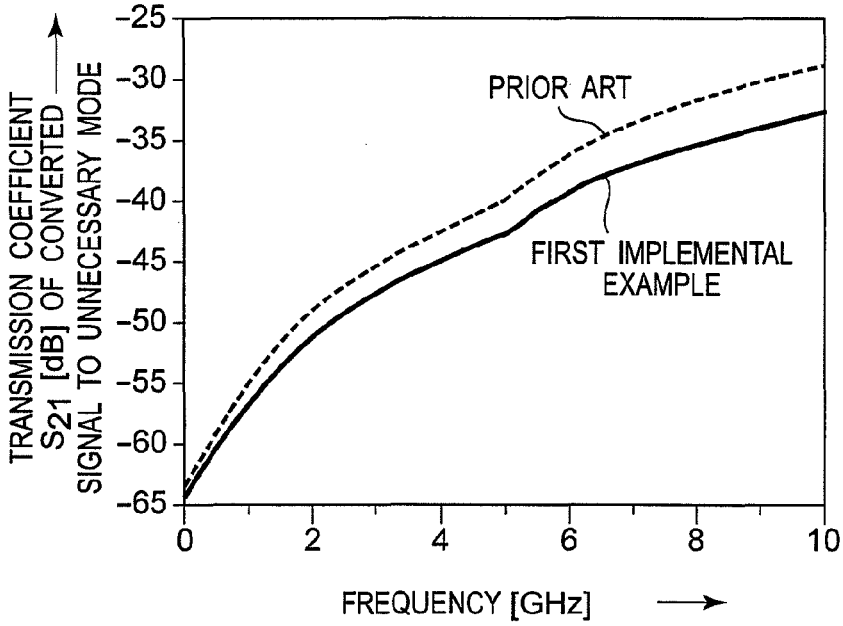
FIG. 9 is a graph showing frequency characteristics of a transmission coefficient $S_{21}$ of a converted signal to an unnecessary mode in a differential transmission line according to a first implemental example and the differential transmission line according to the first prior art.

FIG. 9 is a graph showing frequency [GHz] characteristics of the transmission coefficients $S_{21}$ [dB] of the converted signals to the unnecessary mode in the differential transmission line of the first implemental example and the differential transmission line of the first prior art. In the first implemental example, a converted signal of −35.5 dB to the unnecessary mode was generated at a frequency of 10 GHz. The first implemental example consistently exhibited an improvement of not smaller than 1 dB in the characteristics including those of other frequency bands in comparison with the first prior art, and the advantageous operation and effect of the preferred embodiment of the present invention were proved.

Figure 10:
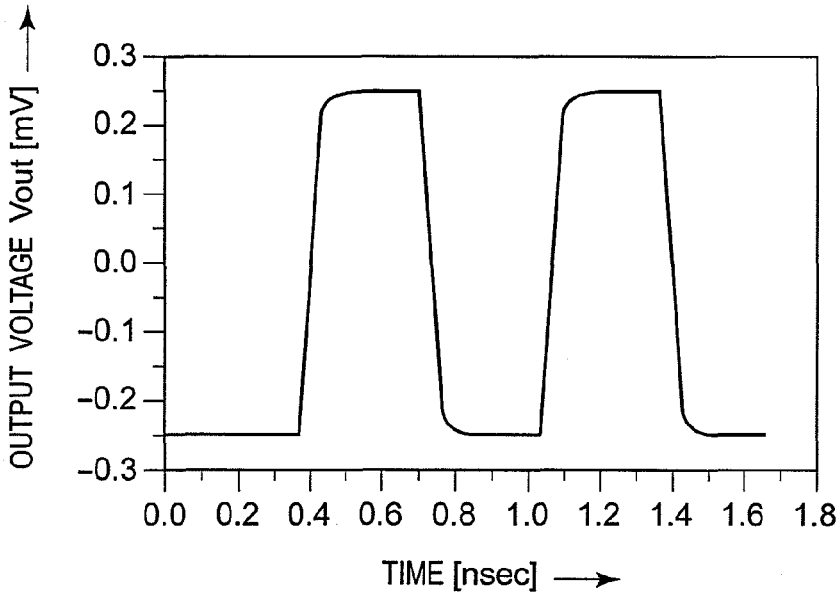
FIG. 10 is a graph showing a signal waveform (output voltage vs. time) at a frequency of 3 GHz according to the first implemental example.
Figure 11:
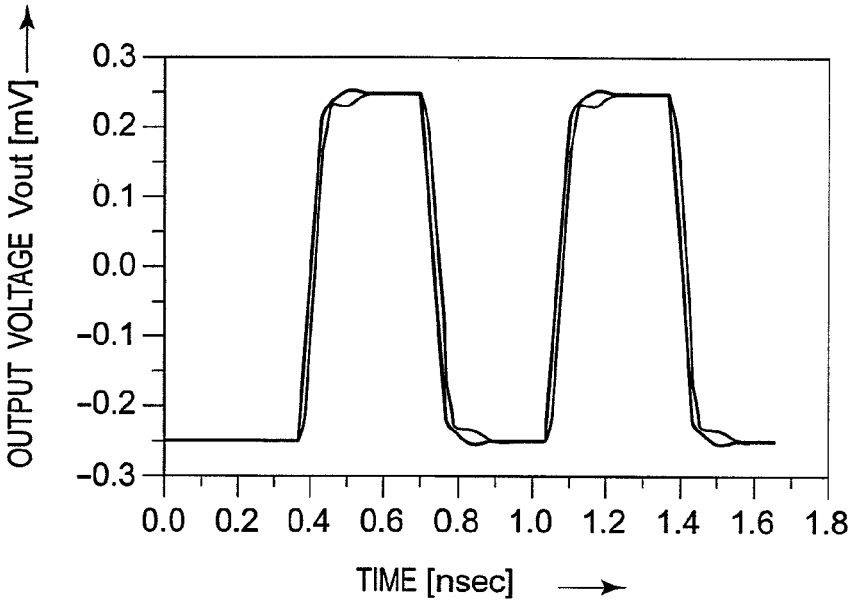
Fig.11 PRIOR ART
FIG. 11 is a graph showing a signal waveform (output voltage vs. time) at a frequency of 3 GHz of the first prior art.
Figure 12:
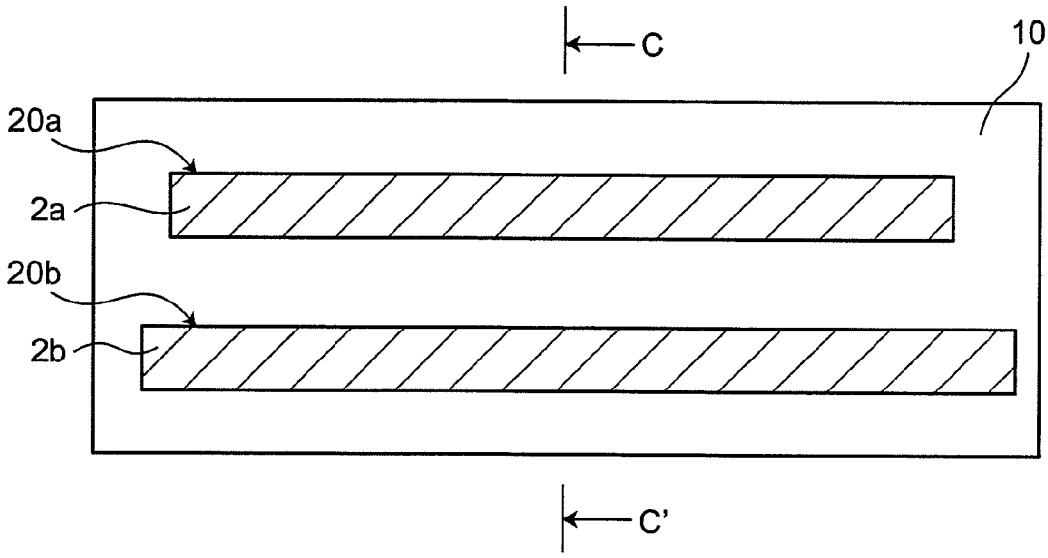
Fig.12 PRIOR ART
FIG. 12 is a top view of a prior art differential transmission line.
Figure 13:
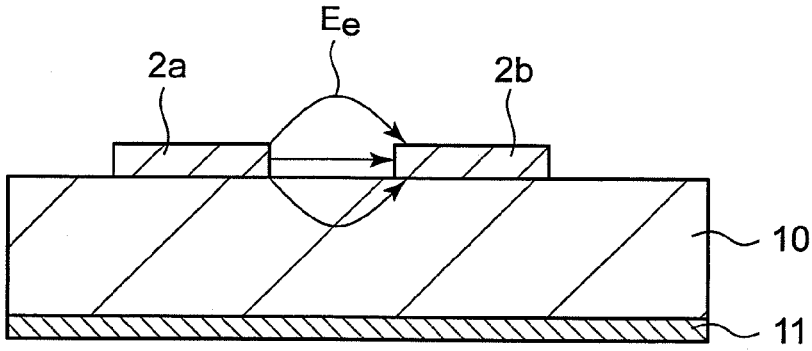
Fig.13 PRIOR ART
FIG. 13 is a longitudinal sectional view taken along the line C-C' of the differential transmission line of FIG. 12, showing an electric field vector in the odd mode.
Figure 14:
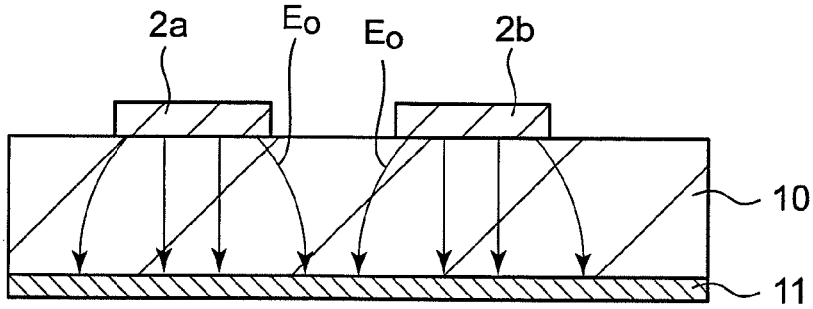
Fig.14 PRIOR ART
FIG. 14 is a longitudinal sectional view taken along the line C-C' of the differential transmission line of FIG. 12, showing an electric field vector in the even mode.
Figure 15:
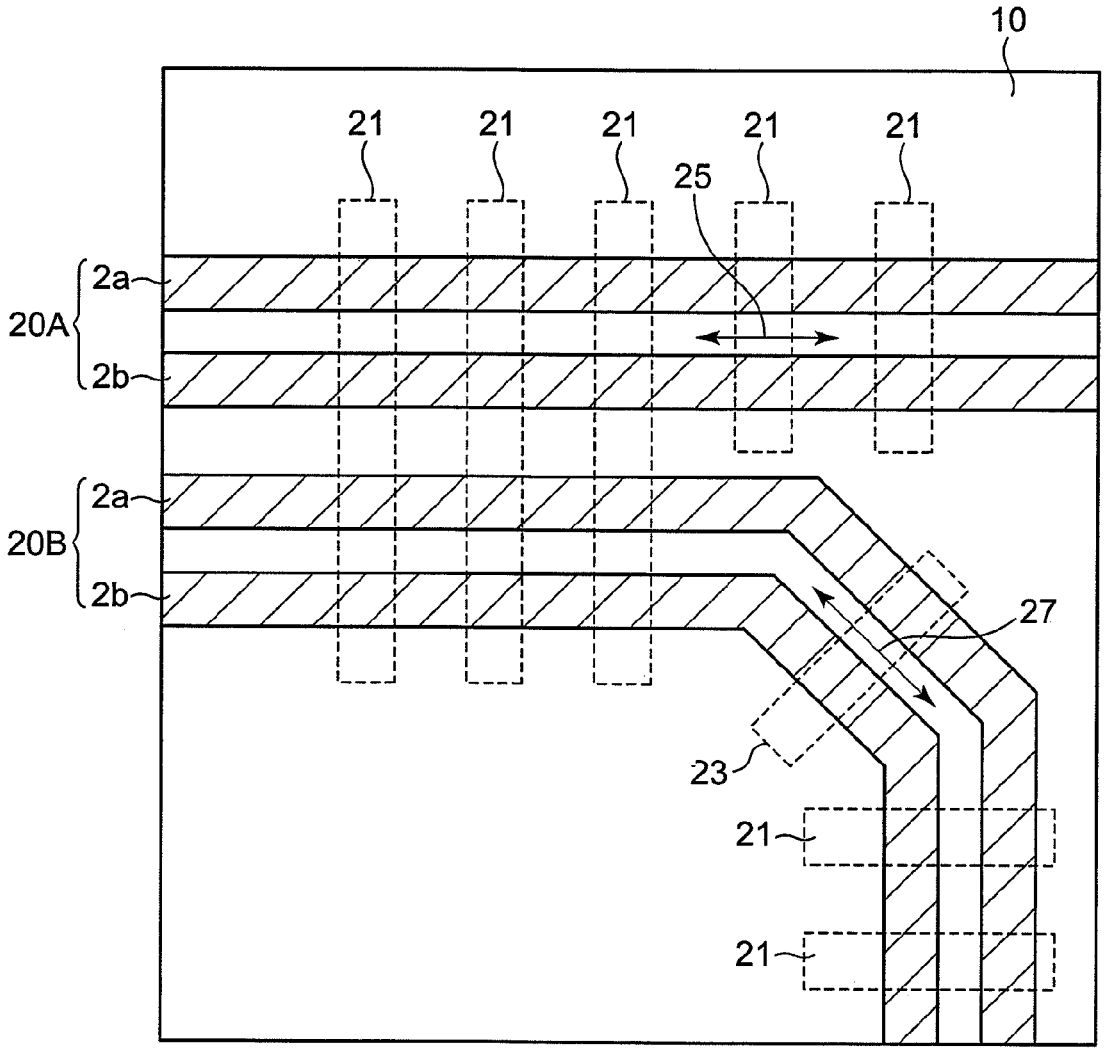
Fig.15 PRIOR ART
FIG. 15 is a top view showing differential transmission lines according to the first prior art.
Figure 16:
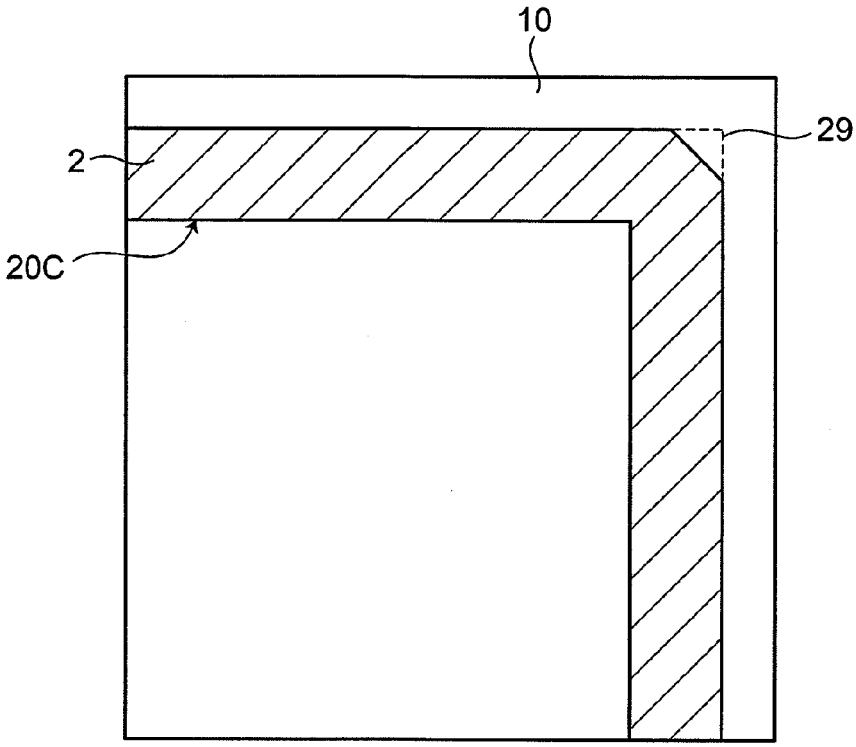
Fig.16 PRIOR ART
FIG. 16 is a top view showing a differential transmission line according to the second prior art.
Figure 17:
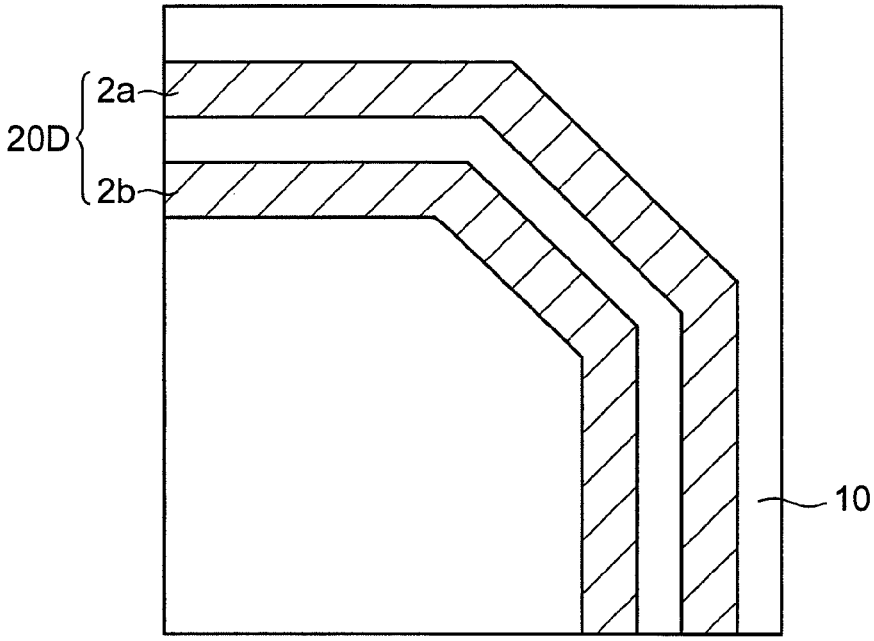
Fig.17 PRIOR ART
FIG. 17 is a top view showing a differential transmission line according to a modification example of the first prior art.
Figure 18:
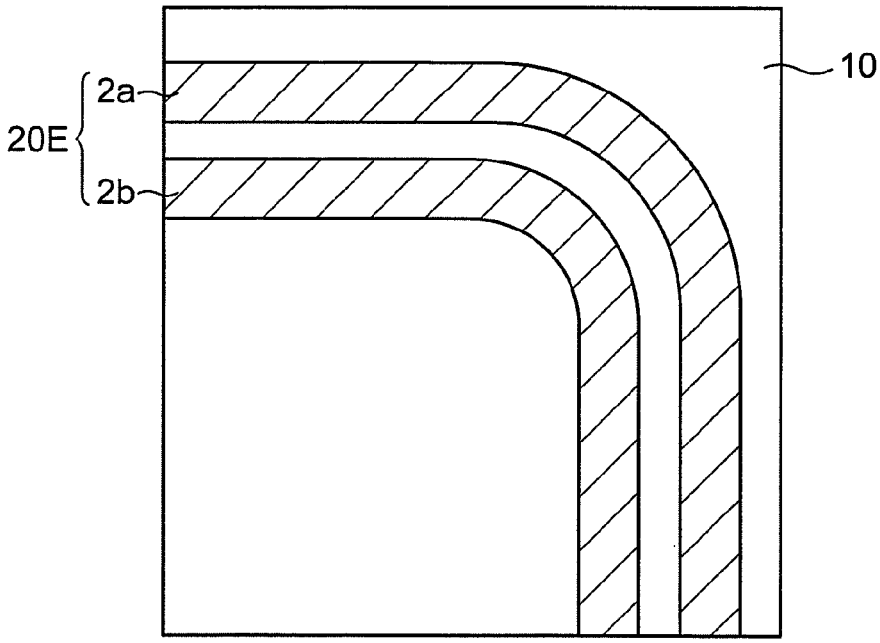
Fig.18 PRIOR ART
FIG. 18 is a top view showing a differential transmission line according to a modification example of the third prior art.

FIG. 10 is a graph showing a signal waveform (output voltage (mV) vs. time (nsec)) at a frequency of 3 GHz according to the first implemental example, and FIG. 11 is a graph showing a signal waveform (output voltage (mV) vs. time (nsec)) at a frequency of 3 GHz according to the first prior art. That is, FIGS. 10 and 11 show the transmission waveforms at a frequency of 3 GHz using the analytical results of the first implemental example and the first prior art. The shown waveforms indicate the amplitude of the voltage across the terminals of the signal conductors 2*a* and 2*b*. It was exhibited that the amplitude of the voltage applied between the signal conductors 2*a* and 2*b* was more uniformed in the first implemental example, and the advantageous operation and effect of the preferred embodiment of the present invention were proved.

As described in detail above, according to the differential transmission line of the present invention, the unnecessary mode conversion, which has occurred due to the bend of the conventional differential transmission line and the difference in the wiring length, can be suppressed, and this leads to a reduction in the amount of unnecessary emission from the electronic equipment. The common-mode suppression filter, which has been introduced for the purpose of removing the unnecessary mode in the conventional differential transmission line, becomes unnecessary, and therefore, the effects of cost reduction, a reduction in the circuit occupation area, and an improvement in the differential-mode transmission signal intensity that has been deteriorated due to the insertion of the common-mode filter and so on are obtained. The present invention can be widely applied not only to data transmission but also to line structures for use in the equipment and devices in the communication fields such as filters, antennas, phase shifters, switches, and oscillators and is usable also in the fields that use wireless technologies such as power transmission and RFID (Radio Frequency Identification) tags.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A differential transmission line comprising:

a substrate having a first surface and a second surface that are substantially parallel to each other, a first grounding conductor disposed on the second surface of the substrate;

a dielectric layer disposed on the first grounding conductor;

a second grounding conductor disposed on the dielectric layer; and first and the second signal conductors disposed so as to be parallel to each other on the first surface of the substrate;

wherein the first signal conductor and the first and second grounding conductors constitute a first transmission line, and the second signal conductor and the first and second grounding conductors constitute a second transmission line;

wherein a slot is disposed in the first grounding conductor so as to three-dimensionally intersect with the first and second signal conductors and to be substantially orthogonal to a longitudinal direction of the first and second signal conductors;

wherein a connecting conductor connects the first grounding conductor with the second grounding conductor;

wherein the slot is disposed so as to penetrate the first grounding conductor in a thickness direction of the first grounding conductor; and wherein the first grounding conductor is divided into two parts so as to be completely separated apart by the slot.

2. The differential transmission line as claimed in claim 1, wherein said slot is one of a plurality of slots formed in the first grounding conductor.

3. The differential transmission line as claimed in claim 1, wherein the slot comprises a bend provided between the first signal conductor and the second signal conductor.

4. The differential transmission line as claimed in claim 3, wherein the slot includes:

a first slot having a first width, the first slot being provided so as to intersect with the first signal conductor; and a second slot having a second width different from the first width, the second slot being provided so as to intersect with the second signal conductor.

5. The differential transmission line as claimed in claim 4, wherein a difference between the first width and the second width is set to be larger than a difference between a length of the first signal conductor and a length of the second signal conductor.

6. The differential transmission line as claimed in claim 5, wherein said slot is one of a plurality of slots formed in the first grounding conductor.

7. The differential transmission line as claimed in claim 4, wherein said slot is one of a plurality of slots formed in the first grounding conductor.

8. The differential transmission line as claimed in claim 3, wherein said slot is one of a plurality of slots formed in the first grounding conductor.

* * * * *

UNITED STATES PATENT AND TRADEMARK OFFICE

CERTIFICATE OF CORRECTION

PATENT NO. : 8,040,200 B2
APPLICATION NO. : 12/486912
DATED : October 18, 2011
INVENTOR(S) : Akira Minegishi et al.

It is certified that error appears in the above-identified patent and that said Letters Patent is hereby corrected as shown below:

IN THE CLAIMS

In column 11, line 33 (claim 1, line 3), “other,” should read --other;--.

Signed and Sealed this
Sixth Day of March, 2012

David J. Kappos

David J. Kappos
*Director of the United States Patent and Trademark Office*